US008050415B2

(12) United States Patent
Wang

(10) Patent No.: US 8,050,415 B2
(45) Date of Patent: Nov. 1, 2011

(54) METHOD AND APPARATUS FOR DETECTING AUDIO SIGNALS

(75) Inventor: Zhe Wang, Shenzhen (CN)

(73) Assignee: Huawei Technologies, Co., Ltd., Shenzhen (CN)

( * ) Notice: Subject to any disclaimer, the term of this patent is extended or adjusted under 35 U.S.C. 154(b) by 0 days.

(21) Appl. No.: 13/093,690

(22) Filed: Apr. 25, 2011

(65) Prior Publication Data

US 2011/0194702 A1 Aug. 11, 2011

Related U.S. Application Data

(63) Continuation of application No. 12/979,194, filed on Dec. 27, 2010, which is a continuation of application No. PCT/CN2010/076447, filed on Aug. 30, 2010.

(30) Foreign Application Priority Data

Oct. 15, 2009 (CN) ..... 2009 1 0110797

(51) Int. Cl.
*H04R 29/00* (2006.01)
*G10L 11/00* (2006.01)

(52) U.S. Cl. ..... 381/56; 704/278; 381/110; 84/616

(58) Field of Classification Search ..... 381/56, 381/57, 110, 124; 704/205, 206, 278; 84/601–604, 84/609, 615, 616
See application file for complete search history.

(56) References Cited

U.S. PATENT DOCUMENTS

| | | | | |
|---|---|---|---|---|
| 6,570,991 | B1 * | 5/2003 | Scheirer et al. | 381/110 |
| 7,116,943 | B2 * | 10/2006 | Sugar et al. | 455/67.11 |
| 7,120,576 | B2 | 10/2006 | Gao | |
| 7,191,128 | B2 * | 3/2007 | Sall et al. | 704/233 |
| 7,206,414 | B2 * | 4/2007 | Schulz | 381/56 |
| 7,266,287 | B2 | 9/2007 | Zhang | |
| 7,326,846 | B2 * | 2/2008 | Terada | 84/609 |
| 7,386,217 | B2 | 6/2008 | Zhang | |
| 7,756,704 | B2 | 7/2010 | Yonekubo et al. | |
| 7,864,967 | B2 * | 1/2011 | Takeuchi et al. | 381/56 |
| 2005/0177362 | A1 | 8/2005 | Toguri | |
| 2008/0033583 | A1 * | 2/2008 | Zopf | 700/94 |
| 2008/0232456 | A1 | 9/2008 | Terashima et al. | |
| 2010/0211385 | A1 | 8/2010 | Sehlstedt | |

FOREIGN PATENT DOCUMENTS

| | | | |
|---|---|---|---|
| CN | 101256772 | A | 9/2008 |
| CN | 101419795 | A | 4/2009 |
| CN | 101494508 | A | 7/2009 |
| CN | 101681619 | A | 3/2010 |
| JP | 2007-298607 | A | 11/2007 |
| WO | WO 2008/143569 | A1 | 11/2008 |

OTHER PUBLICATIONS

International Search Report, PCT/CN2010/076447, dated Dec. 9, 2010, 7 pages.

ITU-T, "Series G: Transmission Systems and Media, Digital Systems and Networks Digital terminal equipments—Coding of voice and audio signals, Generic sound activity detector (GSAD)," G.720.1, Jan. 2010, 26 pages.

* cited by examiner

*Primary Examiner* — Xu Mei
(74) *Attorney, Agent, or Firm* — Slater & Matsil, L.L.P.

(57) ABSTRACT

A method and an apparatus for detecting audio signals are disclosed. The input audio signal is detected to determine whether it is a background frame. The detected background signal is further detected according to a music characterization value and a decision rule. Therefore, background music can be detected, and the classifying performance of the voice/music classifier is improved.

19 Claims, 7 Drawing Sheets

METHOD AND APPARATUS FOR DETECTING AUDIO SIGNALS

This application is a continuation of U.S. patent application Ser. No. 12/979,194, filed on Dec. 27, 2010, which is a continuation of co-pending International Application No. PCT/CN2010/076447, filed on Aug. 30, 2010, which designated the United States and was not published in English, and which claims priority to Chinese Patent Application No. 200910110797.X, filed on Oct. 15, 2009, each of which is incorporated herein by reference in its entirety.

TECHNICAL FIELD

The present invention relates to signal detection technologies in the audio field, and in particular, to a method and an apparatus for detecting audio signals.

BACKGROUND

In a communication system, the input audio signals are generally encoded and then transmitted to the peer. In a communication system, especially, a wireless/mobile communication system, channel bandwidth is scarce. In a bidirectional conversation, the time for one party to speak occupies about half of the total conversation time, and the party is silent in the other half of the conversation time. When the channel bandwidth is stringent, if the communication system transmits signals only when a person is speaking but stops transmitting signals when the person is silent, plenty of bandwidth will be saved for other users. For that purpose, the communication system needs to know when the person starts speaking and when the person stops speaking. That is, the communication system needs to know when a speech is active, which involves Voice Activity Detection (VAD). Generally, when a speech is active, the voice coder performs coding at a high rate; when handling the background signals without voice, the coder performs coding at a low rate. Through the VAD technology, the communication system knows whether an input audio signal is a voice signal or a background noise, and performs coding through different coding technologies.

The foregoing mechanism is practicable in general background environments. However, when the background signals are music signals, low rates of coding deteriorate the subjective perception of the listener drastically. Therefore, a new requirement is raised. That is, the VAD system is required to identify the background music scenario effectively and improve the coding quality of the background music pertinently.

A technology for detecting complex signals is put forward in the Adaptive Multi-Rate (AMR) VAD1. "Complex signals" here refer to music signals. For each frame in the AMR VAD, the maximum correlation vector of this frame is obtained from the AMR coder, and normalized into the range of [0-1]. A long-term moving average correlation vector "corr_hp" of the normalized best_corr_hpm is calculated through the following formula:

$$\text{corr_}hp=\alpha\cdot\text{corr_}hp+(1-\alpha)\cdot\text{best_corr_}hp_m,$$

where $\alpha$ is a forgetting factor that falls within [0.8, 0.98]

The corr_hp of each frame is compared with the upper threshold and the lower threshold. If the corr_hp of 8 consecutive frames is higher than the upper threshold, or the corr_hp of 15 consecutive frames is higher than the lower threshold, the complex signal flag "complex_warning" is set to 1, indicating that a complex signal is detected.

In the process of implementing the present invention, the inventor finds at least the following defects in the prior art.

The prior art can detect music signals, but cannot tell whether the music signals are background music, and cannot apply an appropriate coding technology to the background music signals according to the bandwidth conditions. Moreover, the prior art may treat conventional background noise like babble noise as a complex signal, which is adverse to saving bandwidth.

SUMMARY OF THE INVENTION

The embodiments of the present invention provide a method and an apparatus for detecting audio signals to detect background music among audio signals.

A method for detecting audio signals in an embodiment of the present invention includes dividing an input audio signal into multiple audio signal frames; detecting each of the audio signal frames to determine whether the audio signal frame is a background signal frame; adding a step value to a background frame counter when a background signal frame is detected; obtaining a music characterization value of the background signal frame, and adding the music characterization value to an accumulated background music characterization value; and comparing the accumulated background music characterization value with a threshold when the background frame counter reaches a preset number, and determining that the audio signal is background music if the accumulated background music characterization value fulfills a threshold decision rule.

A coder provided in another embodiment of the present invention includes a background frame recognizer configured to detect each input audio signal frame of a plurality of input audio signal frames and to output a first detection result indicating whether the audio signal frame is a background signal frame; and a background music recognizer configured to detect a background signal frame according to a music characterization value of the background signal frame once the background signal frame is detected and to output a second detection result indicating that background music is detected, wherein the background music recognizer includes a background frame counter configured to add a step value to the counter once the background signal frame is detected; a music characterization value obtaining unit configured to obtain the music characterization value of the background signal frame; a music characterization value accumulator configured to accumulate the music characterization value; and a decider configured to determine that the accumulated music characterization value fulfills a threshold decision rule when the background frame counter reaches a preset number and to output the second detection result indicating that the background music is detected.

In the embodiments of the present invention, the background signal is further detected according to the music characterization value to determine whether the background signal is background music or not. Therefore, the classifying performance of the voice/music classifier is improved, the scheme for processing the background music is more flexible, and the coding quality of background music is improved pertinently.

BRIEF DESCRIPTION OF THE DRAWINGS

To make the technical solution under the present invention clearer, the following outlines the accompanying drawings involved in the description of the embodiments of the present invention. Apparently, the accompanying drawings outlined below are illustrative and not exhaustive, and persons of ordinary skill in the art can derive other drawings from such accompanying drawings without any creative effort.

DETAILED DESCRIPTION OF ILLUSTRATIVE EMBODIMENTS

The following detailed description is given with reference to the accompanying drawings to provide a thorough understanding of the present invention. Evidently, the drawings and the detailed description are merely representative of particular embodiments of the present invention, and the embodiments are illustrative in nature and not exhaustive. All other embodiments, which can be derived by those skilled in the art from the embodiments given herein without any creative effort, shall fall within the scope of the present invention.

Figure 1:
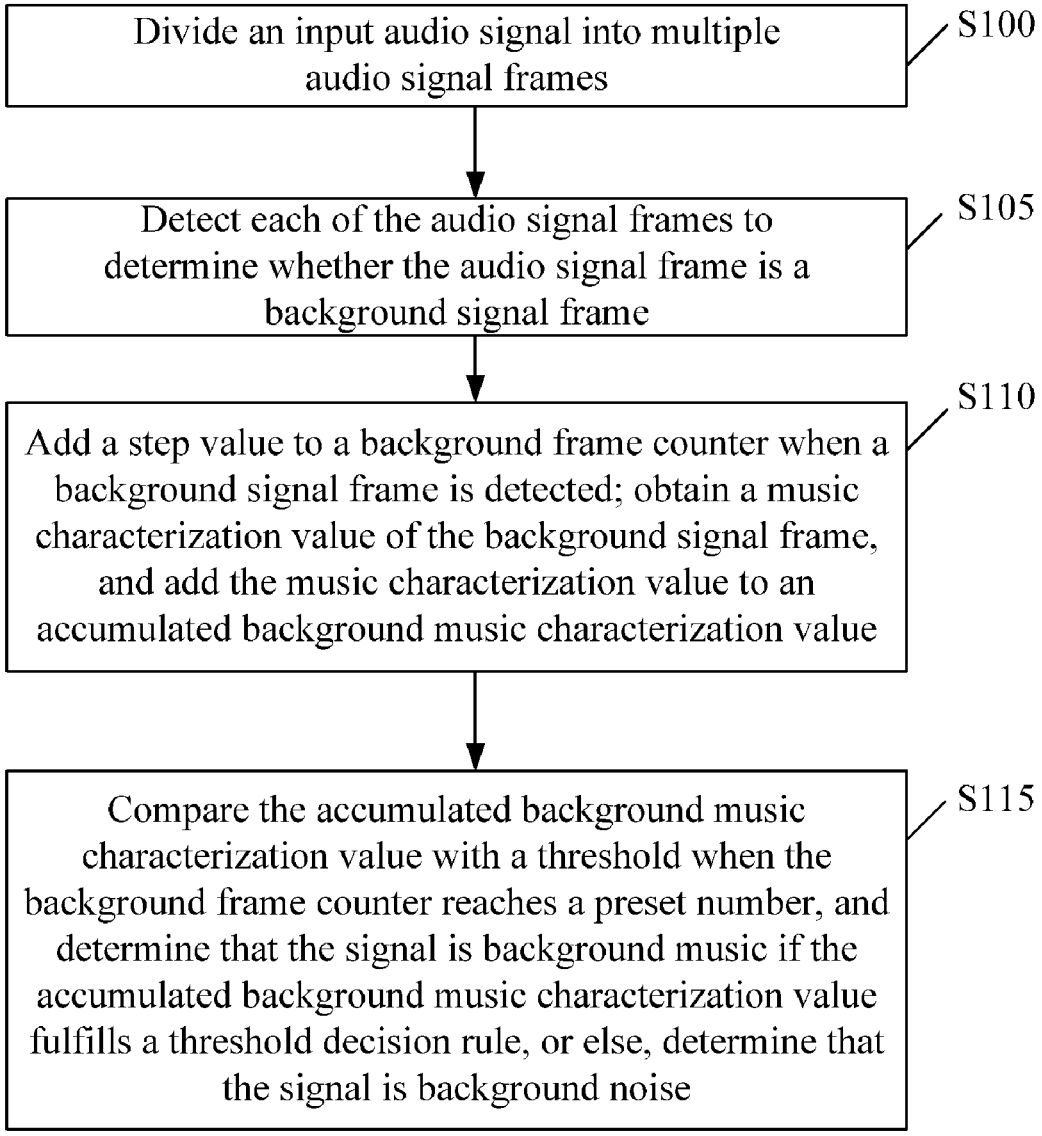
FIG. 1 is a flowchart of a method for detecting audio signals according to an embodiment of the present invention.

A method for detecting audio signals is provided in an embodiment of the present invention to detect audio signals and differentiate between background noise and background music. An audio signal generally includes more than one audio frame. This method is applicable in a preprocessing apparatus of a coder. The background music mentioned in this embodiment refers to the audio signal which is a music signal and a background signal. As shown in FIG. 1, the method includes the following steps.

S100. Divide an input audio signal into multiple audio signal frames.

S105. Detect each of the audio signal frames to determine whether the audio signal frame is a background signal frame.

There are many implementation modes of judging whether the audio signal frame is a foreground signal or a background signal. In an implementation mode, the VAD identifies the foreground signal frame or background signal frame among the input audio signal frames. The VAD identifies the background noise according to inherent characteristics of the noise signal, and keeps tracking and estimates the characteristic parameters of the background noise, for example, characteristic parameter "A". It is assumed that "An" represents an estimate value of this parameter of background noise. For the input audio signal frame, the VAD retrieves the corresponding characteristic parameter "A", whose parameter value is represented by "As". The VAD calculates the difference between the characteristic parameter value "As" and the characteristic parameter value "An" of the input signal. If the difference is less than a threshold, "As" is regarded as close to "An", and the input signal is regarded as background noise; otherwise, "As" is far away from "An", and the input signal is a foreground signal. There may be one or more characteristic parameters "A". If there are more characteristic parameters, a joint parameter difference needs to be calculated.

S110. Add a step value to a background frame counter when a background signal frame is detected; obtain a music characterization value of the background signal frame, and add the music characterization value to an accumulated background music characterization value.

The music characterization value is a characterization value which indicates that the audio signal frame is a music signal. The inventor finds that compared with the background noise, the background music exhibits pronounced peak value characteristic, and the position of the maximum peak value of the background music does not fluctuate obviously. In an embodiment, the music characterization value is calculated out according to the local peak values of the spectrum of the audio signal frame. In another embodiment, the music characterization value is calculated out according to the fluctuation of the position of the maximum peak values of adjacent audio frames. Persons having ordinary skill in the art understand that the music characterization value can be obtained according to other characterization values. The step value is 1 or a number greater than 1.

S115. Compare the accumulated background music characterization value with a threshold when the background frame counter reaches a preset number, and determine that the signal is background music if the accumulated background music characterization value fulfills a threshold decision rule, or else, determine that the signal is background noise.

If the music characterization value is a different parameter, the threshold decision rule varies. In an implementation mode, the music characterization value is a normalized peak-valley distance value, and the threshold decision rule is: If the music characterization value is greater than the threshold, the signal is determined as background music; otherwise, the signal is determined as background noise. In another implementation mode, the music characterization value is fluctuation of the position of the maximum peak value, and the threshold decision rule is: If the music characterization value is less than the threshold, the signal is determined as background music; otherwise, the signal is determined as background noise.

Upon completion of detecting this audio signal, the background frame counter and the accumulated music characterization value are cleared to zero, and another round of audio signal detection begins. Further, a preset number of background signal frames that follow a frame detected as background music are identified as background music, and a protection frame value (which is equal to the preset number) is set. In the subsequent process of detecting audio signals, the protection frame value decreases by 1 whenever a background frame is detected. For example, when the current background signal is determined as background music, a background music protection window is set, namely, b_mus_hangover=1000, indicating that the subsequent 1000 background frames are protected as background music frames. In the subsequent detection process, b_mus_hangover decreases by 1 whenever a background frame is detected. If b_mus_hangover is less than 0, b_mus_hangover is equal to 0. Further, the threshold in the foregoing detection process may be adjusted according to the state of the protection window. When the protection frame value is greater than 0, the first threshold is applied; otherwise, the second threshold is applied. If the threshold decision rule indicates that the accumulated music characterization value is greater than the threshold, the first threshold is less than the second threshold; if the threshold decision rule indicates that the accumulated music characterization value is less than the threshold, the first threshold is greater than the second threshold. After the background music is detected, the frame after the current frame is probably background music too. Through adjustment of the threshold, the audio frame after the detected background music tends to be determined as a background music frame. For example, when a normalized peak-valley distance value represents the music characterization value, if the background music protection window b_mus_hangover is greater than 0, the first threshold mus_thr=1300 is applied; otherwise, the second threshold mus_thr=1500 is applied. Compared with the case that the next frame is background music when the current frame is not background music, it is more probable that the next frame is background music when the current frame is background music. The foregoing method of adjusting the threshold improves accuracy of judgment.

After the background signal is detected as background music, the coding mode of the background music can be adjusted flexibly according to the bandwidth conditions, and the coding quality of the background music can be improved pertinently. Generally, the background music in an audio communication system can be transmitted as a foreground signal, and is encoded at a high rate; when the bandwidth is stringent, the background music can be transmitted as a background signal, and is encoded at a low rate. Besides, recognition of the background music improves the classifying performance of the voice/music classifier, and helps the voice/music classifier adjust the classifying decision method in the case that background music exists, and improves the accuracy of voice detection.

In the foregoing embodiments, the background signal is further detected according to the music characterization value to determine whether the background signal is background music or not. Therefore, the classifying performance of the voice/music classifier is improved, the scheme for processing the background music is more flexible, and the coding quality of background music is improved pertinently.

Figure 2:
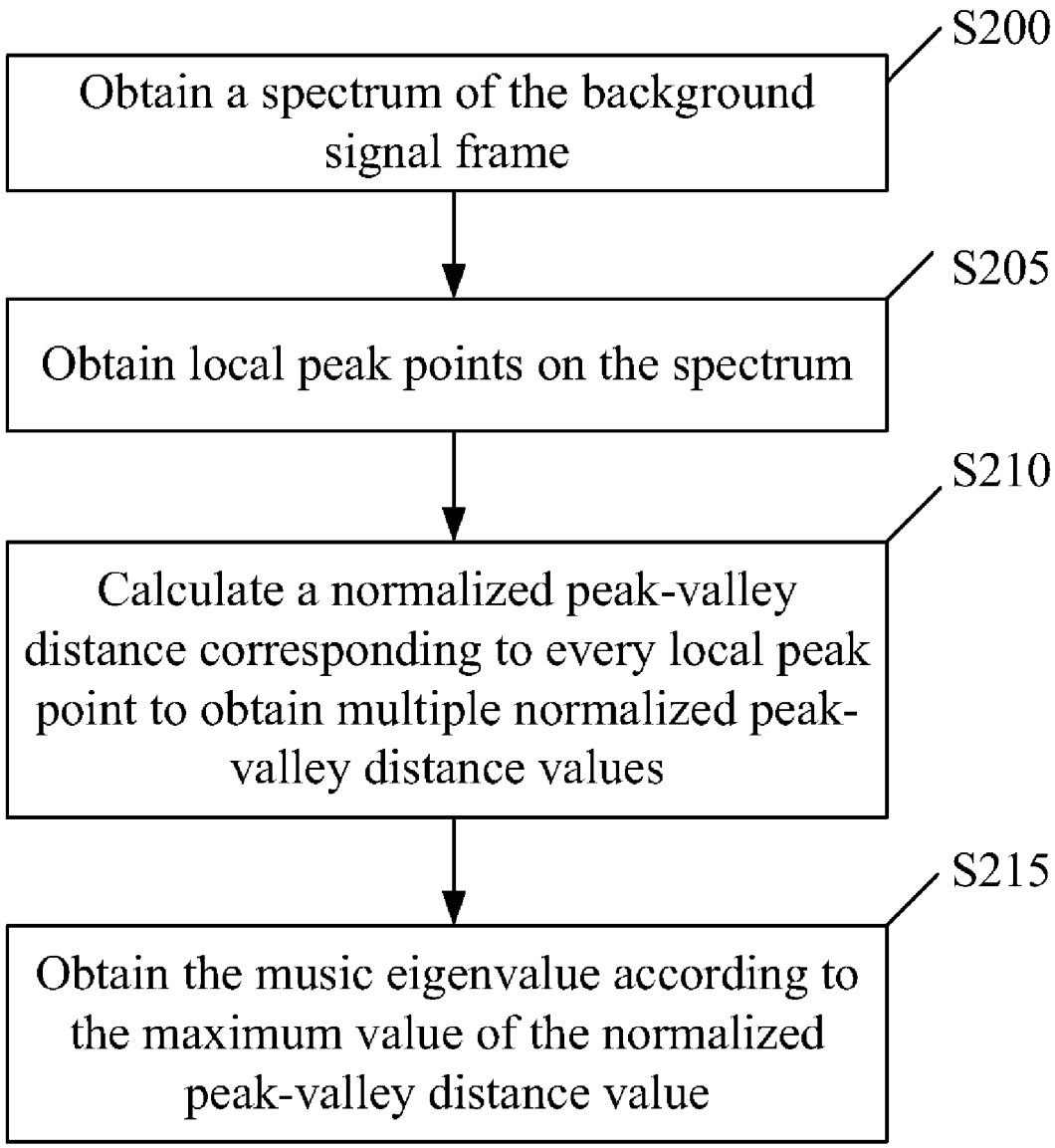
FIG. 2 is a flowchart of obtaining a music characterization value of an audio frame according to an embodiment of the present invention.

As shown in FIG. 2, the process of obtaining the music characterization value of the audio frame in an embodiment of the present invention includes the following steps.

S200. Perform Fast Fourier Transform (FFT) for the input background signal frame to obtain the FFT spectrum.

S205. Obtain the position and energy value of the local peak points on the spectrum.

The position and the energy value of the local peak points on the spectrum are searched out and recorded. A local peak point refers to a frequency whose energy is greater than the energy of the previous frequency and the energy of the next frequency on the spectrum. The energy of the local peak point is a local peak value. Supposing that an $i^{th}$ fft frequency on the spectrum is expressed as fft(i), if fft(i−1)<fft(i) and fft(i+1)<fft(i), the $i^{th}$ frequency is a local peak point, i is the position of the local peak point, and fft(i) is the local peak value. The position and the energy value of all local peak points on the spectrum are recorded.

S210. Calculate the normalized peak-valley distance corresponding to every local peak point according to the position and energy value to obtain multiple normalized peak-valley distance values.

The normalized peak-valley distance can be calculated in different ways. For example, the calculation method is: For each local peak value which is expressed as peak(i), search for the minimum value among several frequencies adjacent to the left side of peak(i), namely, search for vl(i), and search for the minimum value among several frequencies adjacent to the right side of peak(i), namely, search for vr(i); calculate the difference between the local peak value and vl(i), and the difference between the local peak value and vr(i), and divide the sum of the two differences by the average energy value of the spectrum of the audio frame to generate a normalized peak-valley distance. In another embodiment, the sum of the two differences is divided by the average energy value of a part of the spectrum of the audio frame to generate the normalized peak-valley distance. Taking the 64-point FFT spectrum as an example, the normalized peak-valley distance $D_{p2v}(i)$ of the local peak value peak(i) is:

$$D_{p2v}(i) = \frac{2 \cdot peak(i) - vl(i) - vr(i)}{avg} \tag{1}$$

In the formula above, peak(i) represents the energy of the local peak point whose position is i; vl(i) is the minimum value among several frequencies adjacent to the left side of the local peak point whose position is i, and vr(i) is the minimum value among several frequencies adjacent to the right side of the local peak point whose position is i, and avg is the average energy value of the spectrum of this frame.

$$avg = \frac{1}{62}\sum_{i=2}^{63} fft(i) \tag{2}$$

In the formula above, fft(i) represents the energy of the frequency whose position is i.

The number of frequencies adjacent to the left side and the number of frequencies adjacent to the right side can be selected as required, for example, four frequencies. The normalized peak-valley distance corresponding to every local peak point is calculated so that multiple normalized peak-valley distance values are obtained.

In another embodiment, the normalized peak-valley distance is calculated in this way: For every local peak point, calculate the distance between the local peak point and at least one frequency to the left side of the local peak point, and calculate the distance between the local peak point and at least one frequency to the right side of the local peak point; divide the sum of the two distances by the average energy value of the spectrum of the audio frame or the average energy value of a part of the spectrum of the audio frame to generate the normalized peak-valley distance.

For example, peak(i) represents the local peak value whose position is i; as regards the distance between peak(i) and two frequencies adjacent to the left side of peak(i), and the distance between peak(i) and two frequencies adjacent to the right side of peak(i), the sum of the two distances is used to calculate $D_{p2v}(i)$, namely, the normalized peak-valley distance of peak(i):

$$D_{p2v}(i) = \frac{4 \cdot peak(i) - fft(i-1) - fft(i-2) - fft(i+1) - fft(i+2)}{avg} \tag{3}$$

In the formula above, fft(i−1) and fft(i−2) are energy values of the two frequencies adjacent to the left side of the local peak value; fft(i+1) and fft(i+3) are energy values of the two frequencies adjacent to the right side of the local peak value; and avg is the average energy value of the spectrum of the audio frame:

$$avg = \frac{1}{62}\sum_{i=2}^{63} fft(i)$$

S215. Obtain the music characterization value according to the maximum value of the normalized peak-valley distance value.

The maximum value of the normalized peak-valley distance value is selected as the music characterization value; or the sum of at least two maximum values of the normalized peak-valley distance values is the music characterization value. In an implementation mode, three maximum values of the peak-valley distance values add up to the music characterization value. In practice, other peak-valley distance values are also applicable. For example, two or four maximum values of the peak-valley distance values add up to the music characterization value.

The music characterization values of all background frames are accumulated. When the background frame counter reaches a preset number, the accumulated music characterization value is compared with a threshold. The signal is determined as background music if the accumulated music characterization value is greater than the threshold; or else, the signal is determined as background noise.

In this embodiment, the music characterization value is calculated by using the normalized peak-valley distance corresponding to the local peak value. Therefore, the peak value characteristics of the background frame can be embodied accurately, and the calculation method is simple.

Figure 3:
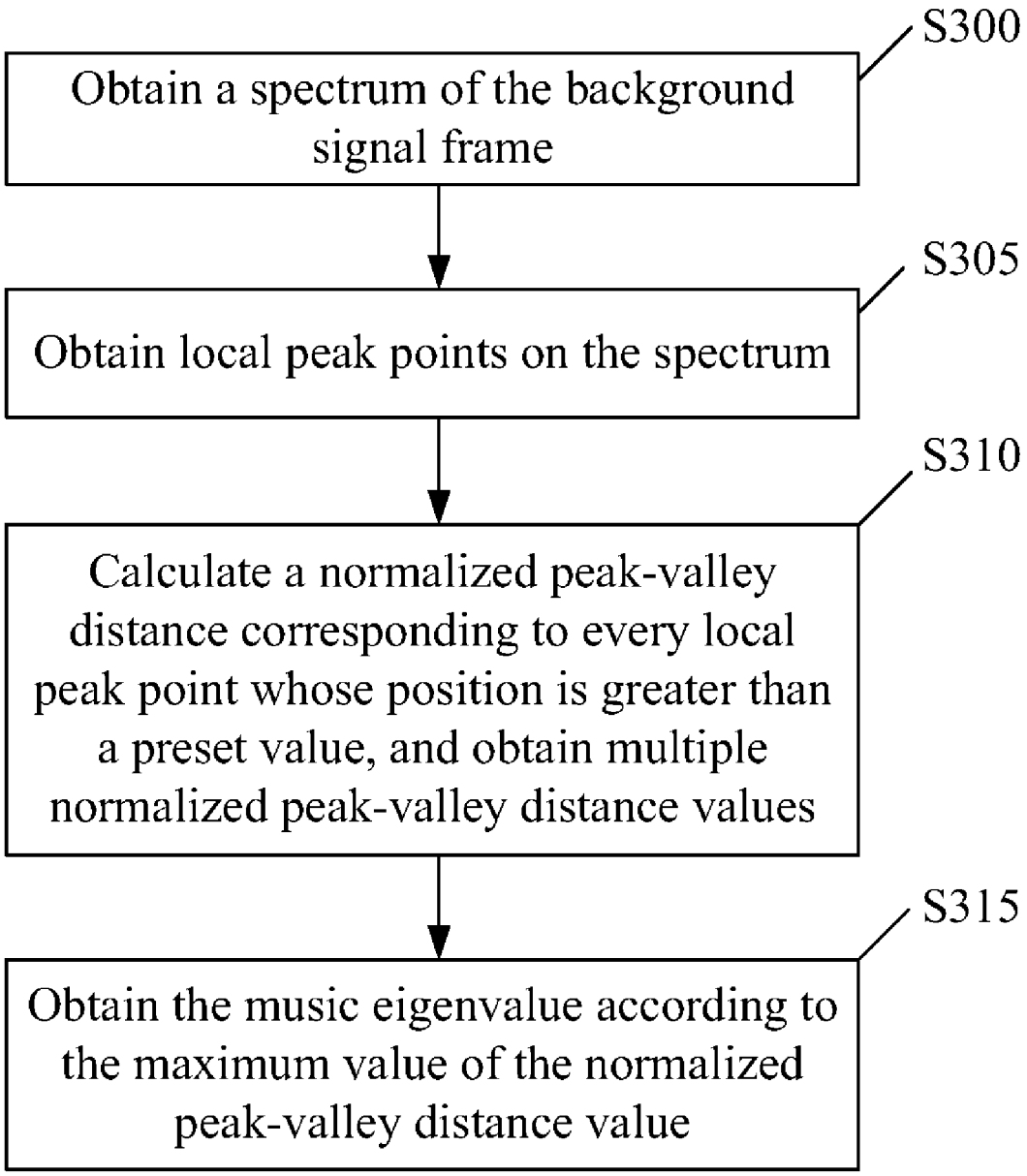
FIG. 3 is a flowchart of obtaining a music characterization value of an audio frame according to another embodiment of the present invention.

As shown in FIG. 3, the process of obtaining the music characterization value of the audio frame in another embodiment of the present invention includes the following steps.

S300. Perform FFT for the input background signal frame to obtain the FFT spectrum.

S305. Select a part of the spectrum, and obtain the position and energy value of the local peak points on the selected part of the spectrum.

The part of the spectrum is at least one local area on the spectrum. For example, the frequencies whose position is greater than 10 are selected, or two local areas are selected among the frequencies whose position is greater than 10. The position and the energy value of the local peak points on the selected spectrum are searched out and recorded. A local peak point refers to a frequency whose energy is greater than the energy of the previous frequency and the energy of the next frequency on the spectrum. The energy of the local peak point is a local peak value. Supposing that an $i^{th}$ fft frequency on the spectrum is expressed as fft(i), if fft(i−1)<fft(i) and fft(i+1) <fft(i), the $i^{th}$ frequency is a local peak point, i is the position of the local peak point, and fft(i) is the local peak value. The position and the energy value of all local peak points on the spectrum are recorded.

S310. Calculate the normalized peak-valley distance corresponding to every local peak point according to the position and energy value to obtain multiple normalized peak-valley distance values.

The normalized peak-valley distance can be calculated in different ways. For example, the calculation method is: For each local peak value which is expressed as peak(i), search for the minimum value among several frequencies adjacent to the left side of peak(i), namely, search for vl(i), and search for the minimum value among several frequencies adjacent to the right side of peak(i), namely, search for vr(i); calculate the difference between the local peak value and vl(i), and the difference between the local peak value and vr(i), and divide the sum of the two differences by the average energy value of the spectrum of the audio frame to generate a normalized peak-valley distance. In another embodiment, the sum of the two differences is divided by the average energy value of a part of the spectrum of the audio frame to generate the normalized peak-valley distance. Taking the 64-point FFT spectrum as an example, the normalized peak-valley distance $D_{p2v}(i)$ of the local peak value peak(i) is:

$$D_{p2v}(i) = \frac{2 \cdot peak(i) - vl(i) - vr(i)}{avg} \tag{1}$$

In the formula above, peak(i) represents the energy of the local peak point whose position is i; vl(i) is the minimum value among several frequencies adjacent to the left side of the local peak point whose position is i, and vr(i) is the minimum value among several frequencies adjacent to the right side of the local peak point whose position is i, and avg is the average energy value of the spectrum of this frame.

$$avg = \frac{1}{62}\sum_{i=2}^{63} fft(i) \tag{2}$$

In the formula above, fft(i) represents the energy of the frequency whose position is i.

The number of frequencies adjacent to the left side and the number of frequencies adjacent to the right side can be selected as required, for example, four frequencies. The normalized peak-valley distance corresponding to every local peak point is calculated so that multiple normalized peak-valley distance values are obtained.

In another embodiment, the normalized peak-valley distance is calculated in this way: For every local peak point, calculate the distance between the local peak point and at least one frequency to the left side of the local peak point, and calculate the distance between the local peak point and at least one frequency to the right side of the local peak point; divide the sum of the two distances by the average energy value of the spectrum of the audio frame or the average energy value of a part of the spectrum of the audio frame to generate the normalized peak-valley distance.

For example, peak(i) represents the local peak value whose position is i; as regards the distance between peak(i) and two frequencies adjacent to the left side of peak(i), and the distance between peak(i) and two frequencies adjacent to the right side of peak(i), the sum of the two distances is used to calculate $D_{p2v}(i)$, namely, the normalized peak-valley distance of peak(i):

$$D_{p2v}(i) = \frac{4 \cdot peak(i) - fft(i-1) - fft(i-2) - fft(i+1) - fft(i+2)}{avg} \tag{3}$$

In the formula above, fft(i−1) and fft(i−2) are energy values of the two frequencies adjacent to the left side of the local peak value; fft(i+1) and fft(i+3) are energy values of the two frequencies adjacent to the right side of the local peak value; and avg is the average energy value of the spectrum of the audio frame:

$$avg = \frac{1}{62}\sum_{i=2}^{63} fft(i)$$

S315. Obtain the music characterization value according to the maximum value of the normalized peak-valley distance value.

The maximum value of the normalized peak-valley distance value is selected as the music characterization value; or the sum of at least two maximum values of the normalized peak-valley distance values is the music characterization value. In an implementation mode, three maximum values of the peak-valley distance values add up to the music characterization value. In practice, other peak-valley distance values are also applicable. For example, two or four maximum values of the peak-valley distance values add up to the music characterization value.

The music characterization values of all background frames are accumulated. When the background frame counter reaches a preset number, the accumulated music characterization value is compared with a threshold. The signal is determined as background music if the accumulated music characterization value is greater than the threshold; or else, the signal is determined as background noise.

In this mode, because it is not necessary to calculate the normalized peak-valley distance of all local peak values, the calculation is further simplified. Generally, the energy of the background noise is centralized in the low-frequency part. The foregoing mode removes the adverse impact of the noise, and improves decision accuracy.

Figure 4:
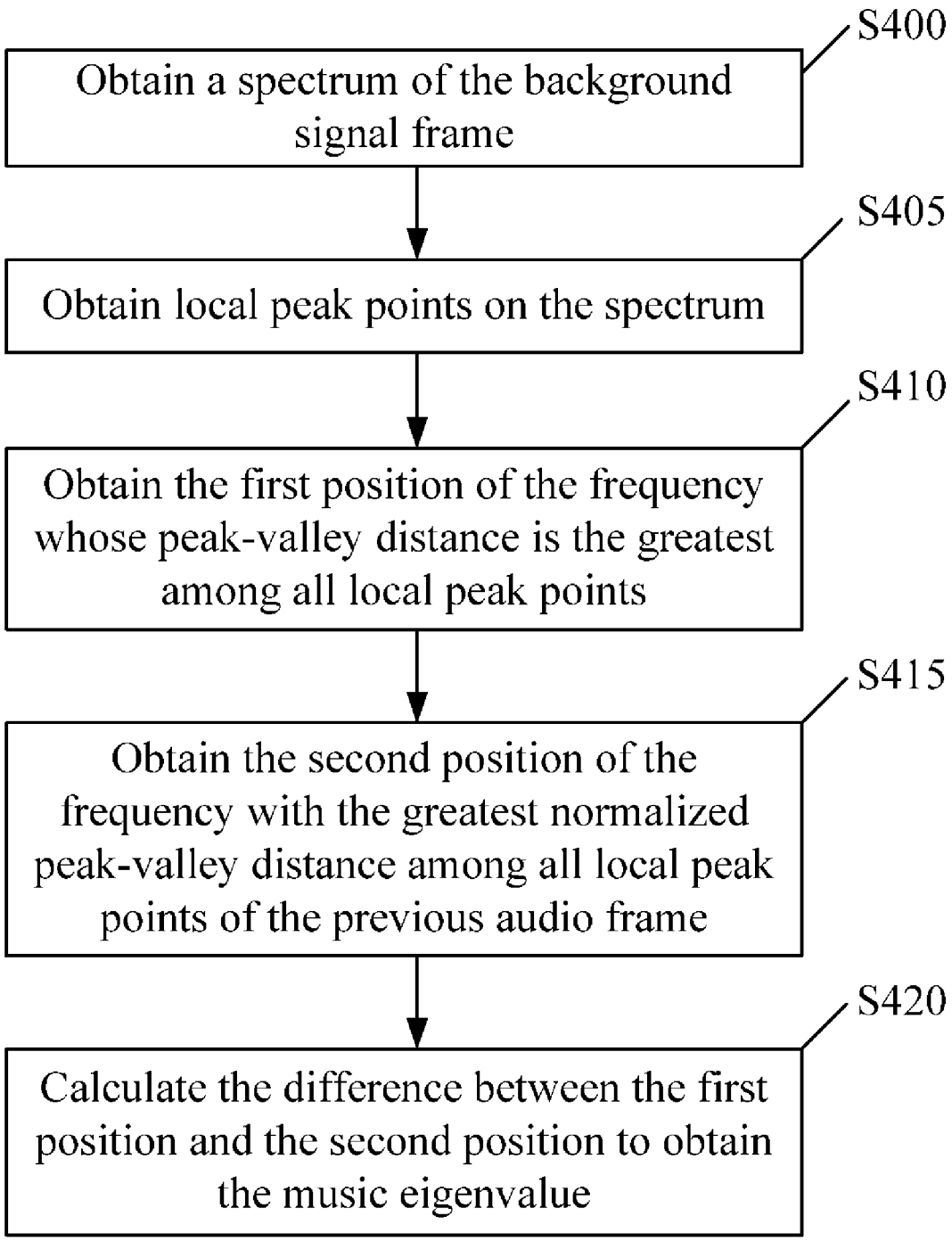
FIG. 4 is a flowchart of obtaining a music characterization value of an audio frame according to another embodiment of the present invention.

As shown in FIG. 4, the process of obtaining the music characterization value of the audio frame in another embodiment of the present invention includes the following steps:

S400. Perform FFT for the input background signal frame to obtain the FFT spectrum.

S405. Obtain the position and energy value of the local peak points on the spectrum.

The position and the energy value of the local peak points on the spectrum are searched out and recorded. A local peak point refers to a frequency whose energy is greater than the energy of the previous frequency and the energy of the next frequency on the spectrum. The energy of the local peak point is a local peak value. Supposing that an $i^{th}$ fft frequency on the spectrum is expressed as fft(i), if fft(i−1)<fft(i) and fft(i+1)<fft(i), the $i^{th}$ frequency is a local peak point, i is the position of the local peak point, and fft(i) is the local peak value. The position and the energy value of all local peak points on the spectrum are recorded.

S410. Obtain the position (hereinafter referred to as the "first position") of the frequency whose peak-valley distance is the greatest among all local peak points according to the position and energy value.

The peak-valley distance corresponding to every local peak point is calculated, the peak point with the greatest peak-valley distance value is obtained, and its position is recorded.

The peak-valley distance can be calculated in different ways. For example, the calculation method is as follows. For each local peak value which is expressed as peak(i), search for the minimum value among several frequencies adjacent to the left side of peak(i), namely, search for vl(i), and search for the minimum value among several frequencies adjacent to the right side of peak(i), namely, search for vr(i); calculate the difference between the local peak value and vl(i), and the difference between the local peak value and vr(i), and add up the two differences to generate the peak-valley distance D. The peak-valley distance D of the local peak value peak(i) is:

$$D=2\cdot\text{peak}(i)-vl(i)-vr(i) \tag{4}$$

In the formula above, the number of frequencies adjacent to the left side and the number of frequencies adjacent to the right side can be selected as required, for example, four frequencies. The peak-valley distance corresponding to every local peak point is calculated to generate multiple peak-valley distance values. The maximum peak-valley distance value is selected among them, and the position of the maximum peak-valley distance value is recorded.

In another embodiment, the peak-valley distance is calculated in this way. For every local peak point, calculate the distance between the local peak point and at least one frequency to the left side of the local peak point, and calculate the distance between the local peak point and at least one frequency to the right side of the local peak point; and add up the two distances to generate the peak-valley distance.

For example, peak(i) represents the local peak value whose position is i; as regards the distance between peak(i) and two frequencies adjacent to the left side of peak(i), and the distance between peak(i) and two frequencies adjacent to the right side of peak(i), the sum of the two distances is used to calculate the peak-valley distance D of peak(i):

$$D=4\cdot\text{peak}(i)-fft(i-1)-fft(i-2)-fft(i+1)-fft(i+2) \tag{5}$$

After the peak-valley distance is calculated out, the average energy value of the whole or a part of the spectrum of the audio frame is obtained according to formula 2. The peak-valley distance is divided by the average energy value to normalize the peak-valley distance. For details, see formula 1 and formula 3.

S415. Obtain the position (hereinafter referred to as the "second position) of the frequency with the greatest normalized peak-valley distance among all local peak points of the previous audio frame.

First, the local peak values are searched out, and then the peak value with the greatest peak-valley distance is found according to the calculation method described in the foregoing step, and the position of this peak value is recorded.

S420. Calculate the difference between the first position and the second position to obtain the fluctuation of the position of the maximum peak value as a music characterization value.

For example, if the maximum peak value occurs on the $i^{th}$ frequency of the FFT spectrum of the current audio frame, the fluctuation of the position of the maximum peak value is flux=i−idx_old, where idx_old is the position of the local peak value with the greatest peak-valley distance in the previous audio frame.

The fluctuation of the position of the maximum peak value of every background frame is accumulated. When the background frame counter reaches a preset number, the accumulated fluctuation of the position of the maximum peak value is compared with a threshold. The signal is determined as background music if the accumulated fluctuation is less than the threshold; or else, the signal is determined as background noise.

In comparison with the background noise, the position of the maximum peak value of the background music does not fluctuate obviously. In this embodiment, therefore, the music characterization value is calculated by using the fluctuation of the position of the maximum peak value; the peak value characteristics of the background frame can be embodied accurately, and the calculation method is simplified.

Figure 5:
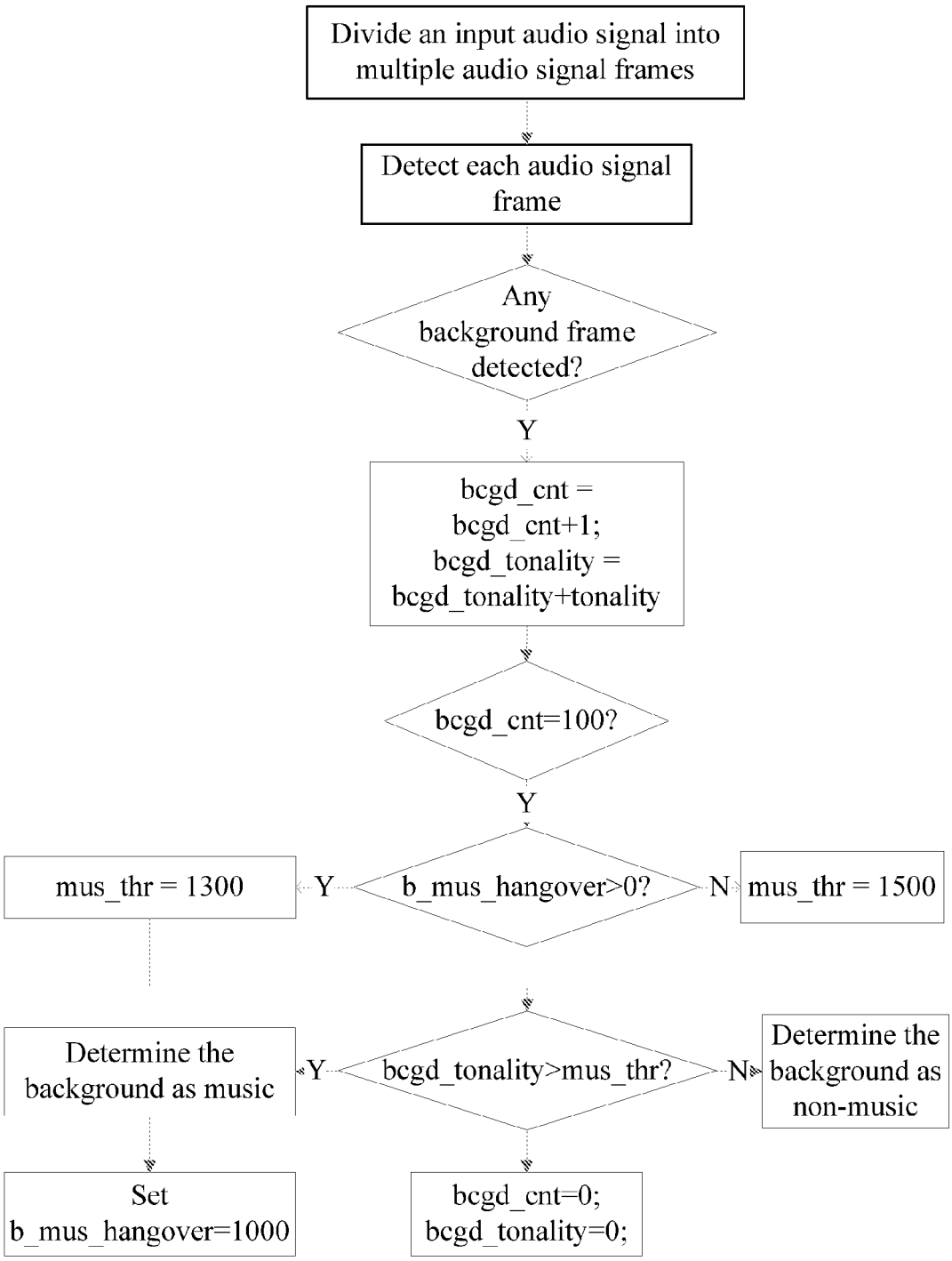
FIG. 5 is a flowchart of a method for detecting audio signals according to another embodiment of the present invention.

As shown in FIG. 5, the following describes an embodiment of the method for detecting audio signals, supposing that the input signals are 8K sampled audio signal frames.

The input signals are 8K sampled audio signal frames, and the length of each frame is 10 ms, namely, each frame includes 80 time domain sample points. In other embodiments of the present invention, the input signals may be signals of other sampling rates.

The input audio signal is divided into multiple audio signal frames, and each audio signal frame is detected. When a background signal is detected, a background frame counter bcgd_cnt increases by 1; and the music characterization value of this frame is added to an accumulated background music characterization value, namely, bcgd_tonality, as expressed below:

After the background frame is detected, $$bcgd_cnt=bcgd_cnt+1$$

$$bcgd_tonality=bcgd_tonality+tonality$$

where tonality denotes the tonality value of the background frame

For a background audio frame, the music characterization value of the frame is obtained in the following way.

The input background audio frames are transformed through 128-point FFT to generate the FFT spectrum. The audio frames before the transformation may be time domain signals which have been filtered through a high-pass filter and/or pre-emphasized. For the obtained FFT spectrum fft(i), where i=0, 1, 2, . . . , 63, the position of the local peak value on the spectrum is searched out and recorded first. With fft(i) representing the $i^{th}$ fft frequency, if fft(i−1)<fft(i) and fft(i+1)<fft(i), the index i is stored in a peak value buffer, namely, peak_buf(k). Each element in the peak_buf is a position index of a spectrum peak value.

With peak(i) representing the local peak value, for each peak(i) whose position index is greater than 10 in the peak_buf, the minimum value among five frequencies adjacent to the left side of peak(i) is expressed as vl(i), and the minimum value among five frequencies adjacent to the right side of peak(i) is expressed as vr(i). $D_{p2v}(i)$ represents the normalized peak-valley distance of peak(i), and is calculated through the following formula:

$$D_{p2v}(i) = \frac{2 \cdot peak(i) - vl(i) - vr(i)}{avg} \tag{1}$$

In the formula above, peak(i) represents the energy of the local peak point whose position is i; vl(i) is the minimum value among several frequencies to the left side of the local peak point whose position is i, and vr(i) is the minimum value among several frequencies to the right side of the local peak point whose position is i, and avg is the average energy value of the spectrum of this frame.

$$avg = \frac{1}{62}\sum_{i=2}^{63} fft(i) \tag{2}$$

In the formula above, fft(i) represents the energy of the frequency whose position is i.

In the obtained $D_{p2v}(i)$ values of all local peak values whose position index is greater than 10, three greatest values are selected and stored. The three greatest values add up to the music characterization value.

When the background frame counter reaches 100 frames, namely, if bcgd_cnt=100, the accumulated background music characterization value bcgd_tonality is compared with a music detection threshold mus_thr. If bcgd_tonality>mus_thr, the current background is determined as music background; otherwise, the current background is determined as non-music background. Afterward, the background frame counter bcgd_cnt and the accumulated background music characterization value bcgd_tonality are cleared to 0.

In the foregoing process, when the current background is determined as music background, a background music protection window is set, namely, b_mus_hangover=1000, indicating that the subsequent 1000 background frames are protected as background music frames. In the subsequent detection process, b_mus_hangover decreases by 1 whenever a background frame is detected. If b_mus_hangover is less than 0, b_mus_hangover is equal to 0. In the foregoing process, the music detection threshold mus_thr is a variable threshold. If the background music protection window b_mus_hangover is greater than 0, mus_thr is equal to 1300; otherwise, mus_thr is equal to 1500.

Persons of ordinary skill in the art should understand that all or part of the steps of the method under the present invention may be implemented by a program instructing relevant hardware. The program may be stored in a computer readable storage medium. When the program runs, the steps of the method specified in any of the embodiments above can be performed. The storage medium may be a magnetic disk, a Compact Disk-Read Only Memory (CD-ROM), a Read Only Memory (ROM), or a Random Access Memory (RAM).

Figure 6:
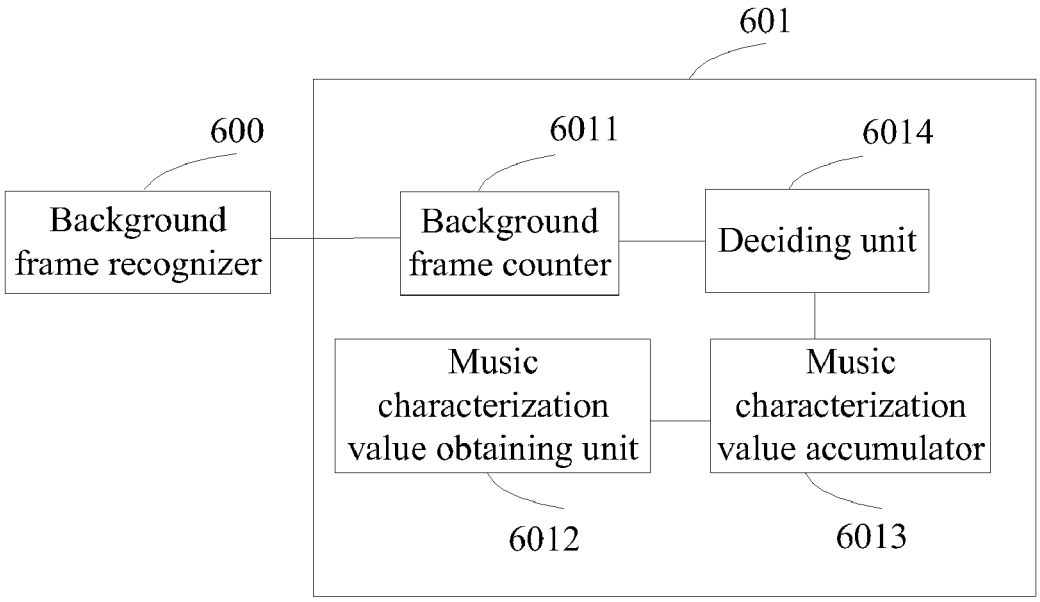
FIG. 6 shows a structure of an apparatus for detecting audio signals according to an embodiment of the present invention.

An apparatus for detecting audio signals is provided in an embodiment of the present invention to detect audio signals and differentiate between background noise and background music. An audio signal generally includes more than one audio frame. The detection apparatus is a preprocessing apparatus of a coder. The audio signal detection apparatus can implement the procedure described in the foregoing method embodiments. As shown in FIG. 6, the audio signal detection apparatus includes a background frame recognizer 600 configured to detect each input audio signal frame of a plurality of input audio signal frames and to output a first detection result indicating whether the audio signal frame is a background signal frame; and a background music recognizer 601 configured to detect a background signal frame according to a music characterization value of the background signal frame once the background signal frame is detected and to output a second detection result indicating that background music is detected. The background music recognizer 601 includes: a background frame counter 6011 configured to add a step value to the counter once the background signal frame is detected; a music characterization value obtaining unit 6012, configured to obtain the music characterization value of the background signal frame; a music characterization value accumulator 6013 configured to accumulate the music characterization value; and a decider 6014 configured to determine that the accumulated music characterization value fulfills a threshold decision rule when the background frame counter reaches a preset number and to output the second detection result indicating that the background music is detected.

The decider 6014 is further configured to determine that the accumulated music characterization value does not fulfill the threshold decision rule, and to output the detection result indicating that non-background music is detected.

If the music characterization value is a different parameter, the threshold decision rule varies. In an implementation mode, the music characterization value is a normalized peak-valley distance value, and the threshold decision rule is: If the music characterization value is greater than the threshold, the signal is determined as background music; otherwise, the signal is determined as background noise. In another implementation mode, the music characterization value is fluctuation of the position of the maximum peak value, and the threshold decision rule is: If the music characterization value is less than the threshold, the signal is determined as background music; otherwise, the signal is determined as background noise.

Upon completion of detecting this audio signal, the background frame counter and the accumulated music characterization value are cleared to zero, and the detection of the next audio signal begins.

The coder further includes a coding unit, which is configured to encode the background music at different coding rates depending on the bandwidth. After the background signal is detected as background music, the coding mode of the background music can be adjusted flexibly according to the bandwidth conditions, and the coding quality of the background music can be improved pertinently. Generally, the background music in an audio communication system can be transmitted as a foreground signal, and is encoded at a high rate; when the bandwidth is stringent, the background music can be transmitted as a background signal, and is encoded at a low rate.

In the foregoing embodiments, the background signal is further detected according to the music characterization value to determine whether the background signal is background music or not. Therefore, the classifying performance of the voice/music classifier is improved, the scheme for processing the background music is more flexible, and the coding quality of background music is improved pertinently.

Figure 7:
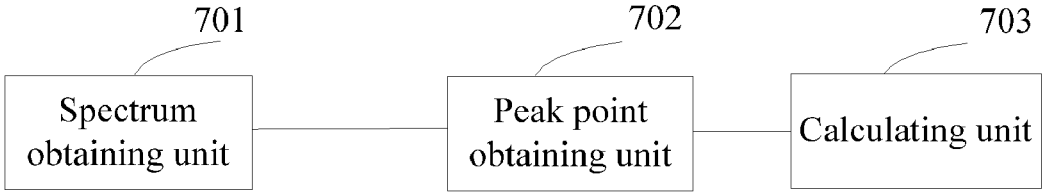
FIG. 7 shows a structure of a music characterization value obtaining unit according to an embodiment of the present invention.

As shown in FIG. 7, in an embodiment, the music characterization value obtaining unit 6012 includes: a spectrum obtaining unit 701 configured to obtain the spectrum of the background signal frame; a peak point obtaining unit 702 configured to obtain the local peak points in at least a part of the spectrum; and a calculating unit 702 configured to calculate the normalized peak-valley distance corresponding to every local peak point to obtain multiple normalized peak-valley distance values, and to obtain the music characterization value according to the multiple normalized peak-valley distance values.

The peak point obtaining unit 702 can obtain all local peak points on the spectrum, or local peak points in a part of the spectrum. A local peak point refers to a frequency whose energy is greater than the energy of the previous frequency and the energy of the next frequency on the spectrum. The energy of the local peak point is a local peak value. The part of the spectrum is at least one local area on the spectrum. For example, the frequencies whose position is greater than 10 are selected, or two local areas are selected among the frequencies whose position is greater than 10.

Specifically, the normalized peak-valley distance of the local peak point can be calculated in the following way.

For each local peak point, obtain the minimum value among four frequencies adjacent to the left side of the local peak point and the minimum value among four frequencies adjacent to the right side of the local peak point.

Calculate the difference between the local peak value and the left-side minimum value, and the difference between the local peak value and right-side minimum value, and divide the sum of the two differences by the average energy value of the spectrum of the audio frame or the average energy value of a part of the spectrum to generate a normalized peak-valley distance. For details of the calculation, see formula 1 and formula 2.

Alternatively, the normalized peak-valley distance of the local peak point can be calculated in the following way.

For every local peak point, calculate the distance between the local peak point and at least one frequency adjacent to the left side of the local peak point, and calculate the distance between the local peak point and at least one frequency adjacent to the right side of the local peak point.

Divide the sum of the two differences by the average energy value of the spectrum or a part of the spectrum of the audio frame to generate the normalized peak-valley distance. For details of the calculation, see formula 3.

Figure 8:
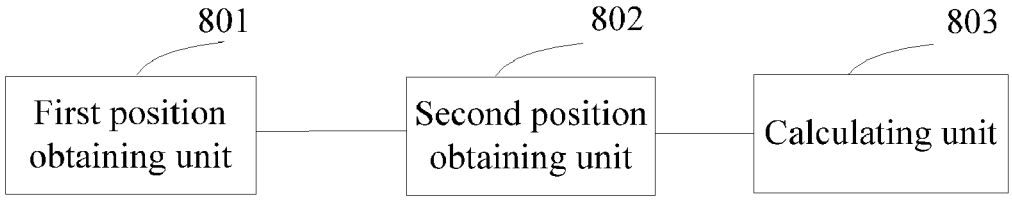
FIG. 8 shows a structure of a music characterization value obtaining unit according to another embodiment of the present invention.

As shown in FIG. 8, in another embodiment, the music characterization value obtaining unit includes: a first position obtaining unit 801 configured to obtain the spectrum of the background signal frame, and to obtain the position (hereinafter referred to as the "first position") of the frequency whose peak-valley distance is the greatest among all local peak values on the spectrum; a second position obtaining unit 802 configured to obtain the spectrum of the frame before the background signal frame, and to obtain the position (hereinafter referred to as the "second position") of the frequency whose peak-valley distance is the greatest among all local peak values on the spectrum; and a calculating unit 803 configured to calculate the difference between the first position and the second position to obtain the music characterization value.

Specifically, using formula 4 or formula 5, the first position obtaining unit and the second position obtaining unit can obtain all peak-valley distances of an audio frame, select the maximum value of the peak-valley distances, and record the corresponding position.

Figure 9:
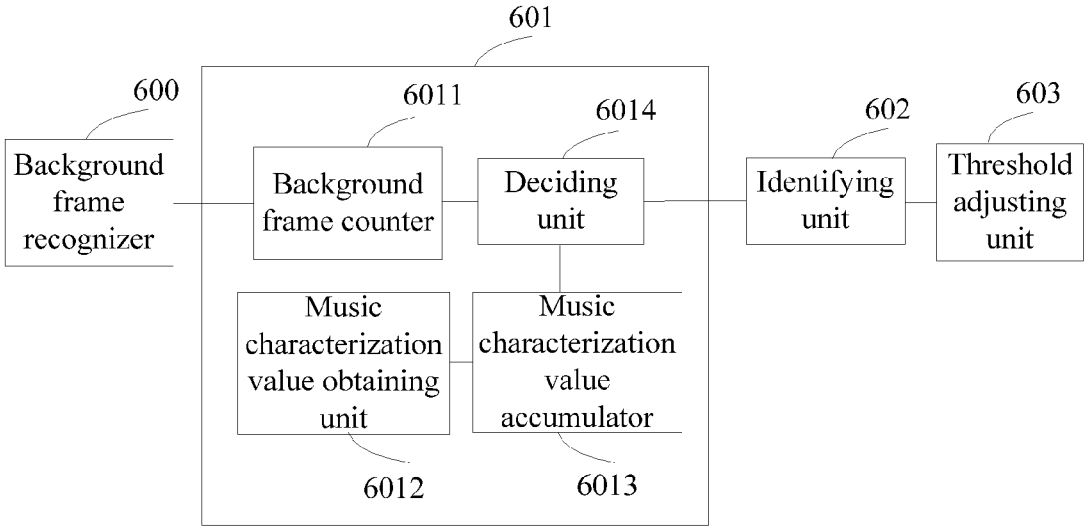
FIG. 9 shows a structure of an apparatus for detecting audio signals according to another embodiment of the present invention.

As shown in FIG. 9, the audio signal detection apparatus further includes: an identifying unit 602 configured to identify a preset number of background signal frames after the current audio frame as background music.

After the background music is detected, a protection window may be applied to protect the preset number of background signal frames after the current audio frame as background music.

The audio signal detection apparatus further includes: a threshold adjusting unit 603 configured to: decrease a preset protection frame value by 1 when a background signal frame is detected; and apply the first threshold if the protection frame value is greater than 0, and otherwise apply the second threshold, where the first threshold is less than the second threshold if the threshold decision rule indicates that the accumulated music characterization value is greater than the threshold, and where the first threshold is greater than the second threshold if the threshold decision rule indicates that the accumulated music characterization value is less than the threshold. After the background music is detected, the frame after the current frame is probably background music too. Through adjustment of the threshold, the audio frame after the detected music background tends to be determined as a background music frame.

The units in the apparatus in the foregoing embodiment may be stand-alone physically, or two or more of the units are integrated into one module physically. The units may be chips, integrated circuits, and so on.

The method and apparatus provided in the embodiments of the present invention are applicable to a variety of electronic devices or are correlated with the electronic devices, including but not limited to: mobile phone, wireless device, Personal Data Assistant (PDA), handheld or portal computer, Global Positioning System (GPS) receiver/navigator, camera, MP3 player, camcorder, game machine, watch, calculator, TV monitor, flat panel display, computer monitor, electronic photo, electronic bulletin board or poster, projector, building structure and aesthetic structure. The apparatus disclosed herein may be configured as a non-display apparatus, which outputs display signals to a stand-alone display apparatus.

Given above are several embodiments of the present invention. Persons skilled in the art understand that modifications and variations can be made to the present invention without departing from the scope or spirit of the present invention.

What is claimed is:

1. A method for detecting audio signals, the method comprising:

dividing an input audio signal into multiple audio signal frames;

detecting each of the audio signal frames to determine whether the audio signal frame is a background signal frame;

adding a step value to a background frame counter when a background signal frame is detected;

obtaining a music characterization value of the background signal frame, and adding the music characterization value to an accumulated background music characterization value; and comparing the accumulated background music characterization value with a threshold when the background frame counter reaches a preset number, and determining that the input audio signal is background music if the accumulated background music characterization value fulfills a threshold decision rule.

2. The method according to claim 1, wherein obtaining the music characterization value of the background signal frame comprises:

obtaining a spectrum of the background signal frame;

obtaining positions and energy values of local peak points in at least a part of the spectrum;

calculating a normalized peak-valley distance corresponding to every local peak point according to the position and energy value to obtain multiple normalized peak-valley distance values; and obtaining the music characterization value according to the multiple normalized peak-valley distance values.

3. The method according to claim 2, wherein calculating the normalized peak-valley distance of each of the local peak points comprises:

for each of the local peak points, obtaining a minimum value among four frequencies adjacent to the left side of the local peak point and a minimum value among four frequencies adjacent to the right side of the local peak point;

calculating a difference between the local peak point and the minimum value among the four frequencies adjacent to the left side, and a difference between the local peak point and the minimum value among the four frequencies adjacent to the right side; and dividing a sum of the two differences by an average energy value of the spectrum or an average energy value of the part of the spectrum to generate the normalized peak-valley distance.

4. The method according to claim 2, wherein calculating the normalized peak-valley distance of each of the local peak points comprises:

for each of the local peak points, calculating a distance between the local peak point and at least one frequency to the left side of the local peak point, and calculating a distance between the local peak point and at least one frequency to the right side of the local peak point; and dividing a sum of the two differences by an average energy value of the spectrum or the part of the spectrum to generate the normalized peak-valley distance.

5. The method according to claim 2, wherein obtaining the music characterization value according to the multiple normalized peak-valley distance values comprises:

selecting a maximum value of the normalized peak-valley distance values as the music characterization value; or adding up at least two maximum values of the normalized peak-valley distance values to obtain the music characterization value.

6. The method according to claim 2, wherein the threshold decision rule comprises a rule wherein the accumulated background music characterization value is greater than the threshold.

7. The method according to claim 1, wherein obtaining the music characterization value of the background signal frame comprises:

according to a spectrum of the background signal frame, obtaining a first position of a frequency whose peak-valley distance is greatest among all local peak values on the spectrum;

according to a spectrum of a frame before the background signal frame, obtaining a second position of the frequency whose peak-valley distance is the greatest among all local peak values on the spectrum of the frame before the background signal frame; and calculating a difference between the first position and the second position to obtain the music characterization value.

8. The method according to claim 7, wherein the threshold decision rule comprises a rule wherein the accumulated background music characterization value is less than the threshold.

9. The method according to claim 1, wherein:

the threshold is adjusted according to a protection frame value, such that if the protection frame value is greater than 0, a first threshold is applied, and if the protection frame value is not greater than 0, a second threshold is applied.

10. The method according to claim 1, wherein after determining that the input audio signal is background music, the method further comprises:

identifying a preset number of audio frames after a current audio frame as the background music.

11. The method according to claim 10, further comprising:

decreasing a preset protection frame value by 1 when the background signal frame is detected; and applying a first threshold if the protection frame value is greater than 0, and applying a second threshold if the protection frame value is not greater than 0, wherein the first threshold is less than the second threshold if the threshold decision rule indicates that the accumulated background music characterization value is greater than the threshold, and wherein the first threshold is greater than the second threshold if the threshold decision rule indicates that the accumulated background music characterization value is less than the threshold.

12. A coder, comprising:

a background frame recognizer configured to detect each input audio signal frame of a plurality of input audio signal frames and to output a first detection result indicating whether the audio signal frame is a background signal frame; and a background music recognizer configured to detect the background signal frame according to a music characterization value of the background signal frame once the background signal frame is detected and to output a second detection result indicating that background music is detected, wherein the background music recognizer comprises:

a background frame counter configured to add a step value to the counter once the background signal frame is detected;

a music characterization value obtaining unit configured to obtain the music characterization value of the background signal frame;

a music characterization value accumulator configured to accumulate the music characterization value of the background signal frame; and a decider configured to determine that the accumulated music characterization value fulfills a threshold decision rule when the background frame counter reaches a preset number and to output the second detection result indicating that the background music is detected.

13. The coder according to claim 12, wherein the music characterization value obtaining unit comprises:

a spectrum obtaining unit configured to obtain a spectrum of the background signal frame;

a peak point obtaining unit configured to obtain local peak points in at least a part of the spectrum; and a calculating unit configured to calculate a normalized peak-valley distance corresponding to each obtained local peak point to obtain multiple normalized peak-valley distance values and to obtain the music characterization value according to the multiple normalized peak-valley distance values.

14. The coder according to claim 13, wherein the normalized peak-valley distance of each obtained local peak point is calculated as follows:

for each obtained local peak point, obtaining a minimum value among four frequencies adjacent to the left side of the local peak point and a minimum value among four frequencies adjacent to the right side of the local peak point; and calculating a difference between the obtained local peak value and the minimum value among the four frequencies adjacent to the left side, and a difference between the local peak value and the minimum value among the four frequencies adjacent to the right side, and dividing a sum of the two differences by an average energy value of the spectrum or an average energy value of the part of the spectrum to generate the normalized peak-valley distance.

15. The coder according to claim 13, wherein the normalized peak-valley distance of each obtained local peak point is calculated as follows:

for each obtained local peak point, calculating a distance between the obtained local peak point and at least one frequency to the left side of the obtained local peak point, and calculating a distance between the obtained local peak point and at least one frequency to the right side of the obtained local peak point; and dividing a sum of the two differences by an average energy value of the spectrum or the part of the spectrum to generate the normalized peak-valley distance.

16. The coder according to claim 12, wherein the music characterization value obtaining unit comprises:

a first position obtaining unit configured to obtain a spectrum of the background signal frame and to obtain a first position of a frequency whose peak-valley distance is greatest among all local peak values on the spectrum;

a second position obtaining unit configured to obtain a spectrum of a frame before the background signal frame and to obtain a second position of the frequency whose peak-valley distance is the greatest among all local peak values on the spectrum of the frame before the background signal frame; and a calculating unit configured to calculate a difference between the first position and the second position to obtain the music characterization value.

17. The coder according to claim 12, further comprising:

an identifying unit configured to identify a preset number of audio frames after a current audio frame as the background music.

18. The coder according to claim 17, further comprising:

a threshold adjusting unit configured to:

decrease a preset protection frame value by 1 when the background signal frame is detected; and apply a first threshold if the protection frame value is greater than 0, and apply a second threshold if the protection frame value is not greater than 0, wherein the first threshold is less than the second threshold if the threshold decision rule indicates that the accumulated music characterization value is greater than the threshold, and wherein the first threshold is greater than the second threshold if the threshold decision rule indicates that the accumulated music characterization value is less than the threshold.

19. The coder according to claim 12, wherein:

the decider is further configured to determine that the accumulated music characterization value does not fulfill the threshold decision rule when the background frame counter reaches the preset number and to output a third detection result indicating that non-background music is detected.

* * * * *